US006997419B1

(12) United States Patent
Remington et al.

(10) Patent No.: US 6,997,419 B1
(45) Date of Patent: Feb. 14, 2006

(54) ADJUSTABLE GAGE PLATE ASSEMBLY

(75) Inventors: James A. Remington, Sheffield Village, OH (US); Joseph A. Martin, Cleveland, OH (US); Karl E. Axthelm, Chagrin Falls, OH (US)

(73) Assignee: Cleveland Track Materials, Inc., Cleveland, OH (US)

( * ) Notice: Subject to any disclaimer, the term of this patent is extended or adjusted under 35 U.S.C. 154(b) by 0 days.

(21) Appl. No.: 11/077,803

(22) Filed: Mar. 11, 2005

(51) Int. Cl.
*E01B 3/00* (2006.01)

(52) U.S. Cl. ..... 246/453; 238/288

(58) Field of Classification Search ..... 246/453; 238/288, 264, 277, 280, 282, 287, 290, 291, 238/306, 51, 109, 116
See application file for complete search history.

(56) References Cited

U.S. PATENT DOCUMENTS

| | | | | |
|---|---|---|---|---|
| 358,981 | A * | 3/1887 | Lane | 238/51 |
| 1,363,100 | A * | 12/1920 | English | 238/51 |
| 4,391,425 | A * | 7/1983 | Keep, Jr. | 246/428 |
| 6,305,614 | B1 * | 10/2001 | Adkins et al. | 246/453 |

* cited by examiner

*Primary Examiner*—Mark T. Le
(74) *Attorney, Agent, or Firm*—Thomas S. Baker, Jr.

(57) ABSTRACT

An adjustable gage plate assembly having a pair of gage plate ends each with rail seats that are connected at their inner ends to swivel slide plates of an adjustment assembly which enables the gage plate ends to be moved laterally and angularily relative to each other such that the gage plate assembly may be adjusted to a specified lateral distance and angle between the gage plate end rail seats.

12 Claims, 3 Drawing Sheets

ADJUSTABLE GAGE PLATE ASSEMBLY

CROSS-REFERENCES

None.

FIELD OF THE INVENTION

This invention relates to an adjustable gage plate assembly for use with a switch in railroad trackwork.

BACKGROUND OF THE INVENTION

A switch stand operates to move a pair of switch points of a railroad switch between straight and turnout side stock rails to divert rolling stock from one track to another. Adjacent the switch points, the curved turnout side stock rail bends or curves away from the straight main line side stock rail. Traditionally, railroad gage plate assemblies have been incorporated into railway trackwork at a switch location adjacent the ends of the switch points to provide positive vertical support, correct angular alignment and specified lateral spacing for the straight and turnout side stock rails of the railroad switch. Typically, a railroad gage plate assembly has a pair of machined and fabricated steel gage plate ends that are rigidly connected at their inner ends to a central insulative member which serves to rigidly connect the two gage plate ends and to electrically isolate them. Each of the gage plate ends has a rail seat at the outer or field end thereof which accommodates the base of one of the stock rails. Because the gage plate ends are rigidly connected and because the radii of the turnout side stock rails differs among railroad switch assemblies, a large number of different gage plate assemblies must be manufactured to accommodate the different lateral distances and different switch angles which occur between a straight main line side stock rail and a curved turnout side stock rail. It is not unusual for a railroad to have to inventory as many as fifty different gage plate assemblies to accommodate the different switch configurations within their trackwork.

It is desirable to provide a single gage plate assembly which accommodates substantially all of the different lateral spacings and switch angles which may occur between the straight (main line) side and turnout side stock rails within different railroad switches.

SUMMARY OF THE INVENTION

An adjustable gage-plate assembly has a first gage plate end having a rail seat defined in part by a riser and a stop at the field end thereof and a lateral pivot adjustment element at the inner end thereof and a second gage plate end having a rail seat defined in part by a riser and a stop at the field end thereof and a lateral pivot adjustment element at the inner end thereof. An adjustment assembly is incorporated in the adjustable gage plate assembly and has first and second swivel slide plates separated by and affixed to an insulator member. The first swivel slide plate has a complimentary lateral pivot adjustment member at the outer end thereof and the second swivel slide plate has a complimentary lateral pivot adjustment member at the outer end thereof. The lateral pivot adjustment elements of the first and second gage plate ends are cooperatively affixed to the complimentary lateral pivot adjustment members of the first and second swivel plates respectively to enable the gage plate assembly to be adjusted to different lateral distances and/or different angles between the rail seats of the first and second gage plate ends.

DESCRIPTION OF THE PREFERRED EMBODIMENT

Figure 1:
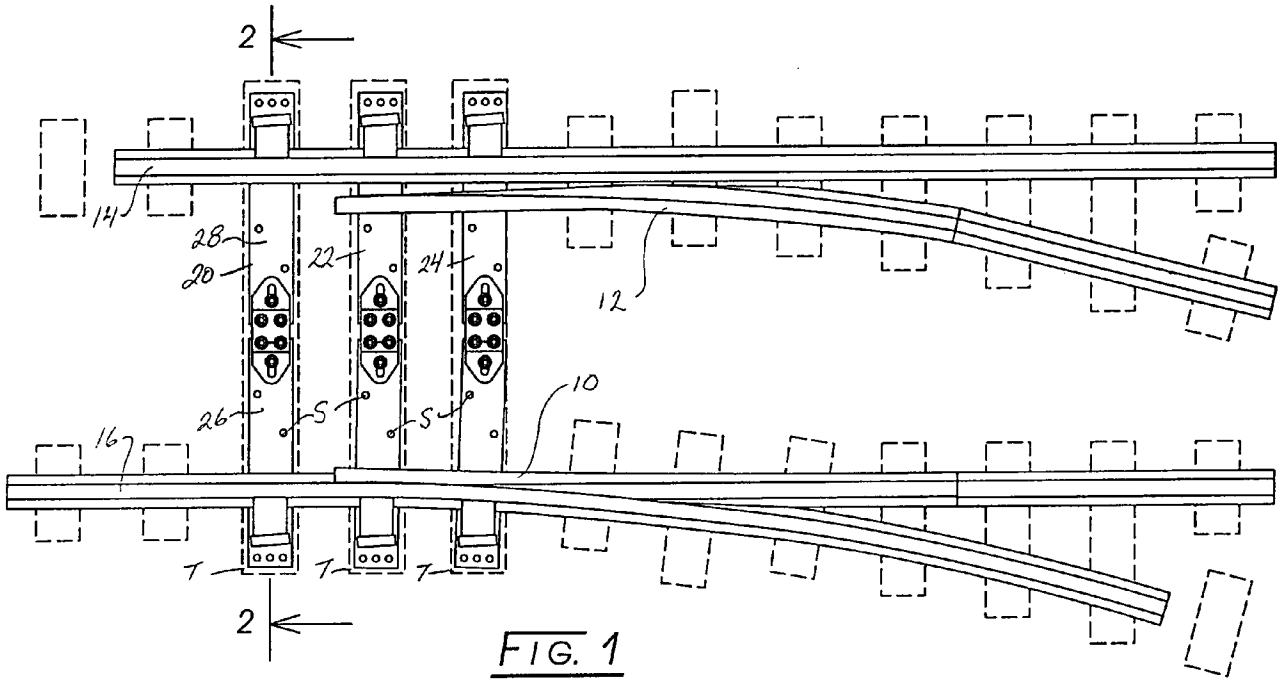
FIG. 1 is a plan view of a right hand switch incorporating three gage plate assemblies of the instant invention.

FIG. 1 illustrates a right hand switch having straight and curved switch points 10 and 12 which are moveable alternatively into contact with a straight main line side stock rail 14 or a curved turnout side stock rail 16. Three adjustable gage plate assemblies 20, 22 and 24 are affixed to ties T by spikes S in the switch adjacent the ends of the moveable switch points 10 and 12.

It should be noted that the three adjustable gage plate assemblies 20, 22 and 24 have substantially identical components. However, the three adjustable gage plate assemblies are adjusted differently to accommodate the different lateral spacings and different angular alignments between the main line and turnout side stock rails 14 and 16 at different locations within the switch. The adjustment of the adjustable gage plate assemblies 20, 22 and 24 will be discussed in greater detail herein below.

Figure 2:
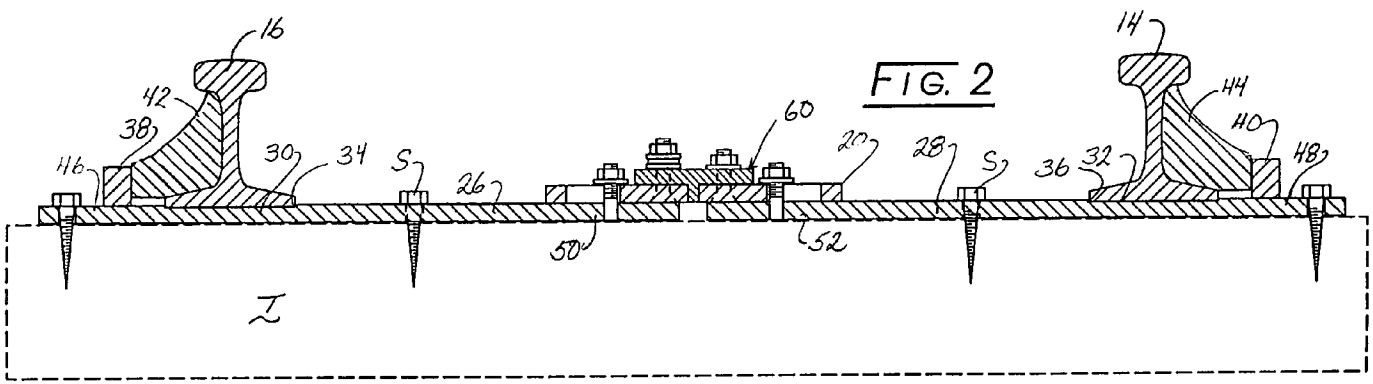
FIG. 2 is a cross sectional view along line 2—2 of FIG. 1.
Figure 3:
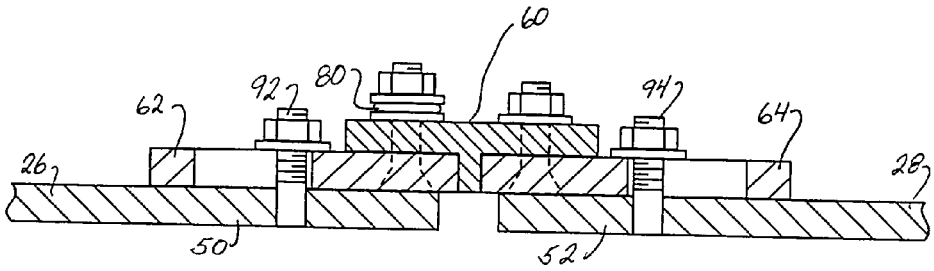
FIG. 3 is an enlarged sectional view of the adjustment assembly at the central portion of FIG. 2.
Figure 4:
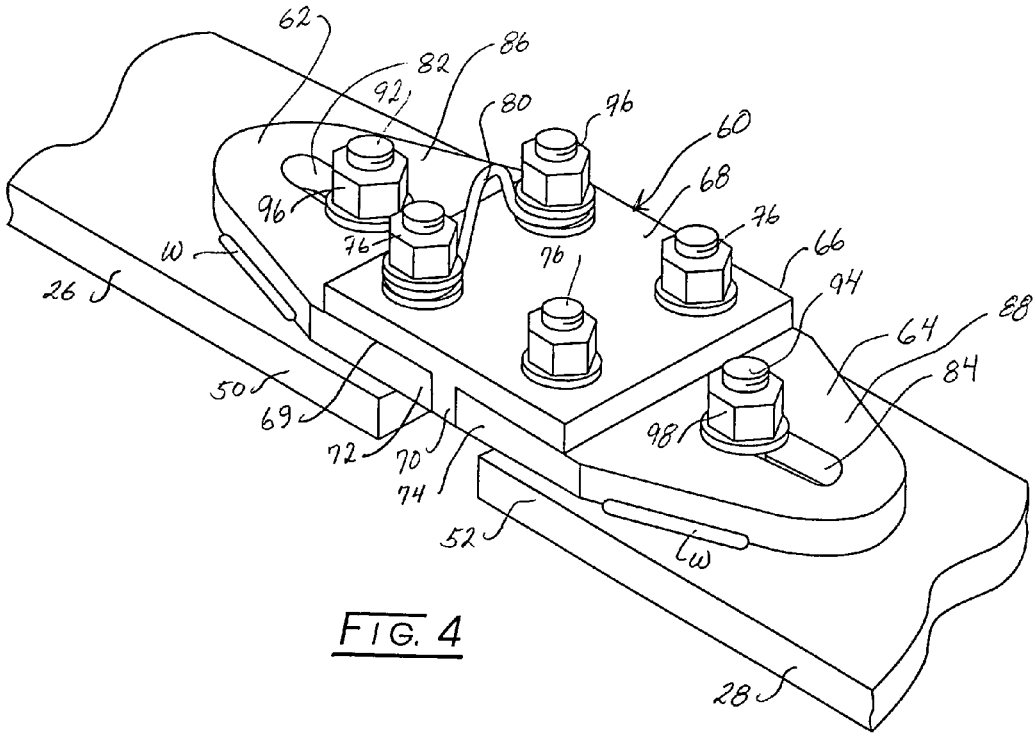
FIG. 4 is a perspective view of the center adjustment assembly of the adjustable gage plate assembly of the instant invention.

FIG. 2 is a cross sectional view of adjustable gage plate assembly 20. Gage plate assembly 20 has a pair of gage plate ends 26 and 28. The gage plate ends 26 and 28 have rail seats 30 and 32, each defined in part by a riser 34 and 36 and a stop 38 and 40. Any conventional clip and brace assembly, illustrated generically by elements 42 and 44, may be utilized to retain turnout and main line side stock rails 16 and 14 in their respective rail seats 30 and 32 at the outer or field ends 46 and 48 of the gage plates 26 and 28. Gage plate ends 26 and 28 are securely connected at their inner ends 50 and 52 to an adjustment assembly 60, best shown in FIGS. 3 and 4.

Adjustment assembly 60 has a pair of swivel slide plates 62 and 64 separated by a T-shaped insulator member 66. T-shaped insulator 66 has a generally horizontal planar top surface 68 and a downwardly depending lateral rib 70 extending from a generally horizontal planar bottom surface 69. The inner ends 72 and 74 of the swivel slide plates 62 and 64 are abutted to the downwardly depending lateral rib 70 and are rigidly attached to insulator member 66 by a plurality of fastener assemblies 76. From this it may be seen that insulator member 66 electrically isolates the swivel slide plates 62 and 64. It should be noted that the exact configuration of insulator member 66 is unimportant. As an example insulator member 66 would function as intended if downwardly depending lateral rib 70 were eliminated and there was a gap in its place separating the inner ends 72 and 74 of the swivel slide plates 62 and 64. The swivel slide plates 62 and 64 only need to be secured to each other in such a manner as to be electrically isolated from each other. Such electrical isolation is required to enable proper functioning of the trackwork electrical system, which monitors such things as train location and switch position.

A lift bracket 80 is attached to adjustment assembly 60 by a pair of fastener assemblies 76. This bracket provides for ease of handling of adjustable gage plate assembly 20. It is not essential to the function or operation of the adjustable gage plate assembly 20.

Lateral slots 82 and 84 are formed in the outer ends 86 and 88 of the swivel slide plates 62 and 64. Studs 92 and 94 mounted at the inner ends 50 and 52 of gage plate ends 26 and 28 pass through the lateral slots 82 and 84. Fasteners 96 and 98 threaded onto the studs 92 and 94 serve to clamp the gage plate ends 26 and 28 to the swivel slide plates 62 and 64 and in turn to the insulator member 66. The lateral slots 82 and 84 enable gage plate ends 26 and 28 and their respective studs 92 and 94 to move laterally and to pivot with respect to each other before nuts 96 and 98 are tightened. In this manner, the lateral spacing and angular alignment between the rail seats 30 and 32 in gage plate ends 26 and 28 may be adjusted to a desired specification as will now be described.

Referring again to FIG. 1, it may be recalled that adjustable gage plate assemblies 20, 22 and 24 are affixed to adjacent railroad ties T by spikes S in close proximity to the ends of straight and curved switch points 10 and 12. The curved turnout rail 16 begins to diverge from main line side stock rail 14 at a location between adjacent adjustable gage plate assemblies 20 and 22, commonly referred to as the point of bend P shown in FIG. 5. Because adjustable gage plate assembly 20 is ahead of the point of bend P, it is referred to as a zero angle gage plate assembly. Because the switch angle is zero at this location, the angle between the side of gage plate end 26 and the turnout side stock rail is 90 degrees and the rail seats 30 and 32 of gage plate ends 26 and 28 are parallel to each other. In this position, the gage plate ends 26 and 28 are adjusted only laterally such that their respective rail seats 30 and 32 are at a specified lateral distance to receive the main line and turnout side stock rails 14 and 16. This lateral adjustment may be accomplished by loosening one or both of the fasteners 96 and 98 to enable the gage plate ends 26 and 28 to move laterally. Because the switch angle at the location of adjustable gage plate assembly 20 is zero degrees, the gage plate ends 26 and 28 remain parallel. Subsequent to adjustable gage plate assembly 20 being adjusted to the specified lateral distance, one or both fasteners 96 and 98 are tightened. Thereafter, welds W are applied to the interface between the inner ends 50 and 52 of the gage plate ends 26 and 28 and the swivel slide plates 62 and 64. The welds W function to ensure that no lateral or pivotal movement occurs between the gage plate ends 26 and 28 and the swivel slide plates 62 and 64 of the adjustment assembly 60. In other words, adjustable gage plate assembly 20 becomes a rigid, unitized structure.

Figure 5:
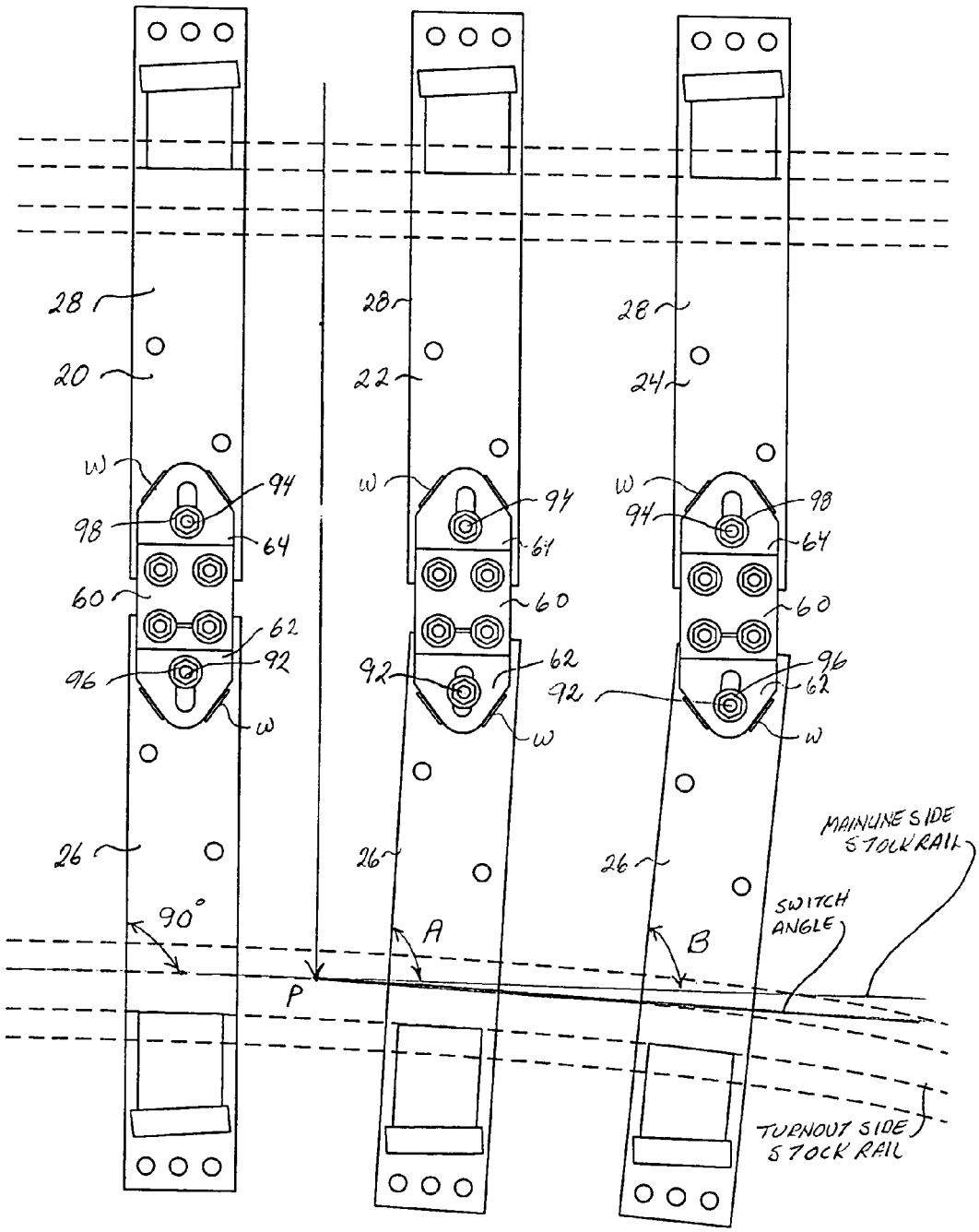
FIG. 5 is a view of the three adjustable gage plate assemblies of FIG. 1 enlarged to emphasize their adjustment features.

Turning again to FIG. 5, it may be seen that adjustable gage plate assemblies 22 and 24 are positioned downstream of the point of bend P. Consequently, the adjustable gage plate assemblies 22 and 24-must be adjusted laterally such that the rail seats 30 and 32 are moved to a specified lateral distance between the main line side stock rail 14 and the turnout side stock rail 16 and must be pivoted such the turnout side rail seats 30 are parallel to the turnout side stock rail. Thus, the sides of the gage plate ends 26 of the adjustable gage plate assemblies 22 and 24 are set at angles A and B, as illustrated in FIG. 5 to accommodate the switch angle at these locations. From this it may be seen that the gage plate ends 26 and 28 are not parallel. Typically, the turnout side stock rail assumes a switch angel of between one-half and three degrees. Subsequent to adjustment, welds W are applied to the inner ends 50 and 52 of the gage plate ends 26 and 28 to rigidly secure the lateral distance between and angular position of the rail seats 30 and 32.

Turning to FIG. 5, it should be noted that the lateral spacing of gage plate end 26 with respect to gage plate end 28 for each of the adjustable gage plate assemblies 20 through 24 is accomplished by moving gage plate end 26 and stud 92 with respect to swivel slide plate 62 of adjustment assembly 60. In other words, the gage plate ends 28 of the gage plate assemblies 20 through 24 did not have to be moved with respect to the adjustment assembly 60. Therefore, in some instances, the swivel slide plates 64 of the adjustment assembly 60 may be welded to the inner ends 52 of the gage plate ends 28 when the gage plate assemblies are manufactured. In this instance, lateral slot 84 would be eliminated from the swivel slide plate 64 and stud 94 would be eliminated from gage plate end 28. Of course, both gage plate ends 26 and 28 may be moved to obtain the desired adjustment of the adjustable gage plate assemblies 20, 22 and 24. In the switch depicted above, three adjustable gage plate assemblies 20, 22 and 24 are shown. Small switches have fewer gage plate assemblies than large switches. Switches normally have between one and seven gage plate assemblies.

Various changes may be made to the size, shape, and relative proportions of the different invention elements disclosed and described herein without departing from the scope, meaning, or intent of the claims which follow.

What is claimed is:

1. An adjustable gage plate assembly comprising:

a first gage plate end having a rail seat defined in part by a riser and a stop at the field end thereof and a lateral pivot adjustment element at the inner end thereof;

a second gage plate end having a rail seat defined in part by a riser and a stop at the field end thereof and a lateral pivot adjustment element at the inner end thereof;

an adjustment assembly having first and second swivel slide plates separated by and affixed to an insulator member;

said first swivel slide plate having a complementary lateral pivot adjustment member at the outer end thereof;

said second swivel slide plate having a complementary lateral pivot adjustment member at the outer end thereof;

said lateral pivot adjustment elements of said first and second gage plate ends being cooperatively affixed to said complementary lateral pivot adjustment members of said first and second swivel plates respectively to enable said gage plate assembly to be adjusted to different lateral distances and or different angles between said rail seats of said first and second gage plate ends.

2. The adjustable gage plate assembly of claim 1 further comprising a lift bracket affixed to said adjustment assembly.

3. The adjustable gage plate assembly of claim 1 wherein said first and second swivel slide plates are rigidly affixed to the inner ends of said first and second gage plate ends by welds to maintain the lateral distance and angle between said rail seats set by the adjustment of the gage plate assembly.

4. An adjustable gage plate assembly comprising:

a first gage plate end having a rail seat defined in part by a riser and a stop at the field end thereof and a lateral pivot adjustment element at the inner end thereof;

a second gage plate end having a rail seat defined in part by a riser and a stop at the field end thereof;

and adjustment assembly having first and second swivel slide plates separated by and affixed to an insulator member;

said first swivel slide plate having a complementary lateral pivot adjustment member at the outer end thereof;

said lateral pivot adjustment element of said first gage plate end being cooperatively affixed to said complementary lateral pivot adjustment member of said first swivel slide plate to enable said gage plate assembly to be adjusted to different lateral distances and or different angles between said rail seats of said first and second gage plate ends.

5. The adjustable gage plate assembly of claim 4 further comprising a lift bracket affixed to said adjustment assembly.

6. The adjustable gage plate assembly of claim 4 wherein said first swivel slide plate is rigidly affixed to the inner end of said first gage plate end by welding to maintain the lateral distance and or angle between said rail seats set by the adjustment of the gage plate assembly.

7. An adjustable gage plate assembly comprising:

a first gage plate end having a rail seat defined in part by a riser and a stop at the field end thereof and one of a pivot pin or a slot at the inner end thereof;

a second gage plate end having a rail seat defined in part by a riser and a stop at the field end thereof, an adjustment assembly having first and second swivel slide plates separated by an insulator member;

said first swivel slide plate having the other of a pivot pin or slot at the outer end thereof;

said second swivel slide plate being rigidly affixed to said inner end of said second gage plate end; and one of said pivot pin or slot of said first swivel slide plate being in cooperation with the other of said pivot pin or slot of said first gage plate end to provide an adjustment for the lateral distance and or the angle between said rail seats of said first and second gage plate ends.

8. The adjustable gage plate assembly of claim 7 further comprising a lift bracket attached to said adjustment assembly.

9. The adjustable gage plate assembly of claim 7 wherein said first swivel slide plate is rigidly affixed to said inner end of said first gage plate end by a weld.

10. The adjustable gage plate assembly of claim 7 wherein said second swivel slide plate is rigidly affixed to said inner end of said second gage plate end by a weld.

11. The adjustable gage plate assembly of claim 7 wherein said first and second swivel slide plates are attached to said insulator member.

12. An adjustable gage plate assembly comprising:

a first gage plate end having a rail seat defined in part by a riser and a stop at the field end thereof and one of a pivot pin or slot at the inner end thereof;

a second gage plate end having a rail seat defined in part by a riser and a stop at the field end thereof and one of a pivot pin or slot at the inner end thereof;

an adjustment assembly having first and second swivel slide plates separated by and attached to an insulator member;

said first swivel slide plate having the other of a pivot pin or slot at the outer end thereof;

said second swivel slide plate having the other of a pivot pin or slot at the outer end thereof; and one of said pivot pin or slot of said first swivel slide plate being in cooperation with the other of said pivot pin or slot of said first gage plate end and one of said pivot pin or slot of said second swivel slide plate being in cooperation with the other of said pivot pin or slot of said second gage plate end to provide an adjustment to adjust the gage plate assembly to different lateral distances and or different angles between said rail seats of said first and second gage plate ends.

* * * * *